US006236336B1

(12) United States Patent
Oliva et al.

(10) Patent No.: US 6,236,336 B1
(45) **Date of Patent: *May 22, 2001**

(54) TRAFFIC INFORMATION WARNING SYSTEM WITH SINGLE MODULATED CARRIER

(75) Inventors: David C. Oliva, Chicago; Phillip Thistlethwaite, Des Plaines, both of IL (US)

(73) Assignee: Cobra Electronics Corp., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/256,883

(22) Filed: Feb. 24, 1999

(51) Int. Cl.[7] ..... G08G 1/00

(52) U.S. Cl. ..... 340/901; 340/905; 340/902; 340/903; 340/904; 340/906; 455/34.1; 455/34.2; 455/59

(58) Field of Search ..... 340/901, 902, 340/903, 904, 905, 906; 455/34.1, 34.2, 59

(56) References Cited

U.S. PATENT DOCUMENTS

| | | | |
|---|---|---|---|
| 3,673,560 | 6/1972 | Barsh et al. . | |
| 3,772,641 | 11/1973 | Grosser et al. . | |
| 3,784,970 | 1/1974 | Simpkin . | |
| 3,997,868 | 12/1976 | Ribnick et al. | 340/33 |
| 4,024,475 | 5/1977 | Brägas et al. . | |
| 4,196,412 | 4/1980 | Sluis et al. | 340/32 |
| 4,216,545 | 8/1980 | Flickshu et al. . | |
| 4,443,790 | 4/1984 | Bishop . | |
| 4,479,249 | * 10/1984 | Geesen et al. | 455/208 |
| 4,541,119 | 9/1985 | Cooper et al. | 455/57 |
| 4,717,904 | 1/1988 | Murakami | 340/52 H |
| 4,764,978 | 8/1988 | Argo et al. . | |
| 4,794,394 | 12/1988 | Halstead . | |
| 4,847,589 | 7/1989 | Dobbins | 340/326 |
| 4,894,642 | 1/1990 | Ashbaugh et al. | 340/539 |
| 5,021,780 | 6/1991 | Fabiano et al. | 340/994 |
| 5,091,906 | 2/1992 | Reed et al. . | |
| 5,181,027 | 1/1993 | Shafer | 340/961 |
| 5,235,329 | 8/1993 | Jackson . | |
| 5,289,181 | 2/1994 | Watanabe et al. . | |
| 5,307,060 | 4/1994 | Prevulsky et al. . | |
| 5,402,117 | 3/1995 | Zijderhand | 340/905 |

(List continued on next page.)

OTHER PUBLICATIONS

International Search Report mailed May 13, 1999 for PCT/US98/27823.

*Primary Examiner*—Daryl Pope
(74) *Attorney, Agent, or Firm*—Wallenstein & Wagner, Ltd.

(57) ABSTRACT

A traffic information warning system for conveying first and second messages regarding a traffic situation from a traffic advisory site is disclosed. The system comprises a transmitter adapted for placement at the advisory site and a receiver. The transmitter includes an oscillator for transmitting a first carrier signal and a second carrier signal. The first carrier signal has a first discrete carrier frequency and the second carrier signal has a second discrete carrier frequency. The first and second discrete carrier signal frequencies are located at a frequency location. The first message of a traffic situation is reflective of the specific frequency locations of the first and second discrete frequencies. A modulator modulates the first carrier signal with a modulating signal reflective of the second message regarding the traffic situation. The second carrier signal comprises an unmodulated signal. The receiver includes scanning circuitry for scanning across a predetermined frequency range to detect the first and second carrier signals and circuitry responsive to the detecting means for determining the first message regarding the traffic situation. The receiver further includes a demodulator for retrieving the first retrieved modulating signal about the first carrier signal, and an annunciator for announcing the first and second messages regarding the traffic situation.

20 Claims, 3 Drawing Sheets

U.S. PATENT DOCUMENTS

| | | | |
|---|---|---|---|
| 5,495,242 | 2/1996 | Kick et al. | 340/902 |
| 5,497,148 | 3/1996 | Oliva . | |
| 5,534,847 | 7/1996 | McGregor | 340/432 |
| 5,554,982 | 9/1996 | Shirkey et al. | 340/903 |
| 5,559,508 | 9/1996 | Orr et al. . | |
| 5,594,432 | 1/1997 | Oliva et al. . | |
| 5,635,920 | 6/1997 | Pogue et al. | 340/901 |

* cited by examiner

TRAFFIC INFORMATION WARNING SYSTEM WITH SINGLE MODULATED CARRIER

TECHNICAL FIELD

Applicants' invention relates to a vehicular traffic information system which warns, or otherwise advises, motorists of various traffic hazards and conditions in their particular operating vicinity.

BACKGROUND OF THE INVENTION

Various systems have been proposed to inform motorists of traffic hazards. Some systems use modulated carrier signals to convey traffic information. Others, such as described in U.S. Pat. No. 5,497,148 assigned to the assignee of the present invention, use unmodulated carrier signals to convey traffic information.

Regardless of the type of system used, a problem exists in that the traffic information being communicated may either become distorted or otherwise compromised by interference from nearby signals, such as police radar. The present invention is provided to solve this and other problems while at the same time simply accomplishing these objectives.

SUMMARY OF THE INVENTION

It is an object of the invention to provide a traffic information warning system for conveying traffic information from a traffic advisory site. The traffic advisory site may comprise an emergency vehicle, a roadside hazard, or the like.

In accordance with the invention, the system comprises a transmitter adapted for placement at the advisory site and a receiver.

The transmitter includes an oscillator for transmitting a first carrier signal and a second signal. The first carrier signal has a first carrier frequency and the second carrier signal has a second carrier frequency. The first and second carrier frequencies are within a range of frequencies. The transmitter further has a modulator for modulating the first carrier signal with a modulating signal reflective of a traffic situation. The second carrier signal is an unmodulated signal. The first carrier frequency and the second carrier frequency are spaced apart by a predetermined frequency difference (PDF). The particular message transmitted is defined both by PDF, as well as by the modulating signal.

The receiver includes scanning circuitry, in the form of a programmed microprocessor, for scanning across a predetermined frequency range to detect the first and second detected carrier signals within the range of frequencies. The receiver determines the frequency difference of two carrier signals. The receiver further includes a demodulator for retrieving a first retrieved modulating signal about the first detected carrier signal. The receiver demodulates the first retrieved modulating signal for use as additional messages. The receiver also includes means for announcing a message regarding the traffic situation. It is contemplated that the announcing means includes a visual display, an audible device, or both.

Other features and advantages of the invention will be apparent from the following specification taken in conjunction with the following drawings.

DETAILED DESCRIPTION OF THE PREFERRED EMBODIMENT

While this invention is susceptible of embodiments in many different forms, there will herein be described in detail preferred embodiments of the invention with the understanding that the present disclosure is to be considered as an exemplification of the principles of the invention and is not intended to limit the broad aspects of the invention to the embodiments illustrated.

Figure 1:
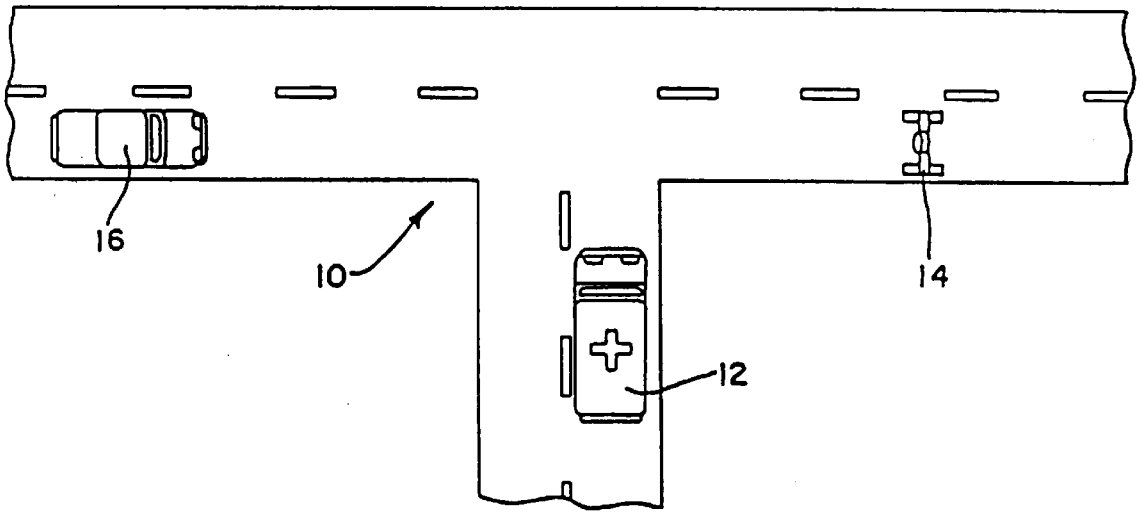
FIG. 1 is a schematic plan view of a traffic situation.
Figure 2:
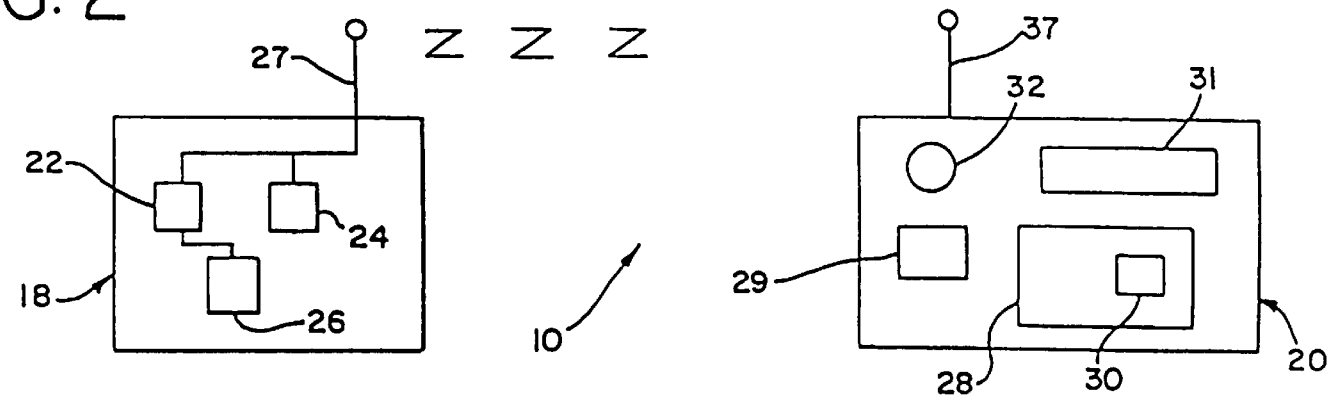
FIG. 2 is a block diagram of a transmitter and a receiver of a traffic hazard warning system in accordance with the invention.

A traffic information warning system, generally designated 10, for conveying a message regarding a traffic situation from a traffic advisory site, such as an emergency vehicle 12 or a roadside hazard 14, to a vehicle 16 is illustrated in FIG. 1. As shown in FIG. 2, the system 10 comprises a transmitter 18 adapted for placement at the advisory site, such as inside the emergency vehicle 12 or alongside the roadside hazard 14. The system 10 further comprises a receiver 20 adapted for placement inside the vehicle 16, or such other locations as desired.

The transmitter 18 includes a first oscillator 22 for transmitting a first carrier signal having a first predetermined carrier frequency $S_1$ and a second oscillator 24 for transmitting a second carrier signal having second predetermined carrier frequency $S_2$. The first and second carrier frequencies are located within a frequency range. The transmitter 18 also includes a modulator 26 for modulating the first carrier signal with a modulating signal M reflective of the traffic situation. The first carrier frequency $S_1$ and the second carrier frequency $S_2$ are spaced apart by a predetermined frequency difference (PDF). The specific PDF generally identifies the particular hazard. In the present embodiment, a PDF of 80 MHz indicates a railroad hazard, a PDF of 120 MHz indicates an emergency vehicle, and a PDF of 160 MHz indicates a road hazard.

According to the invention, the receiver 20 includes scanning circuitry, such as a conventional programmed microprocessor 28, for scanning across the frequency range to detect the first and second carrier signals. The frequency difference of the detected first and second carrier signals is determined by utilizing a receiver with a constant sweep rate, and measuring the time between the two frequency detections, under the control of the microprocessor 28. The receiver further includes memory 30, including a look-up table, wherein acceptable PDF's are stored, as well as acceptable demodulated signals are stored. The receiver further includes an annunciator, in the form of a visual display 31 and an audible display 32, to annunciate received messages.

Figure 3:
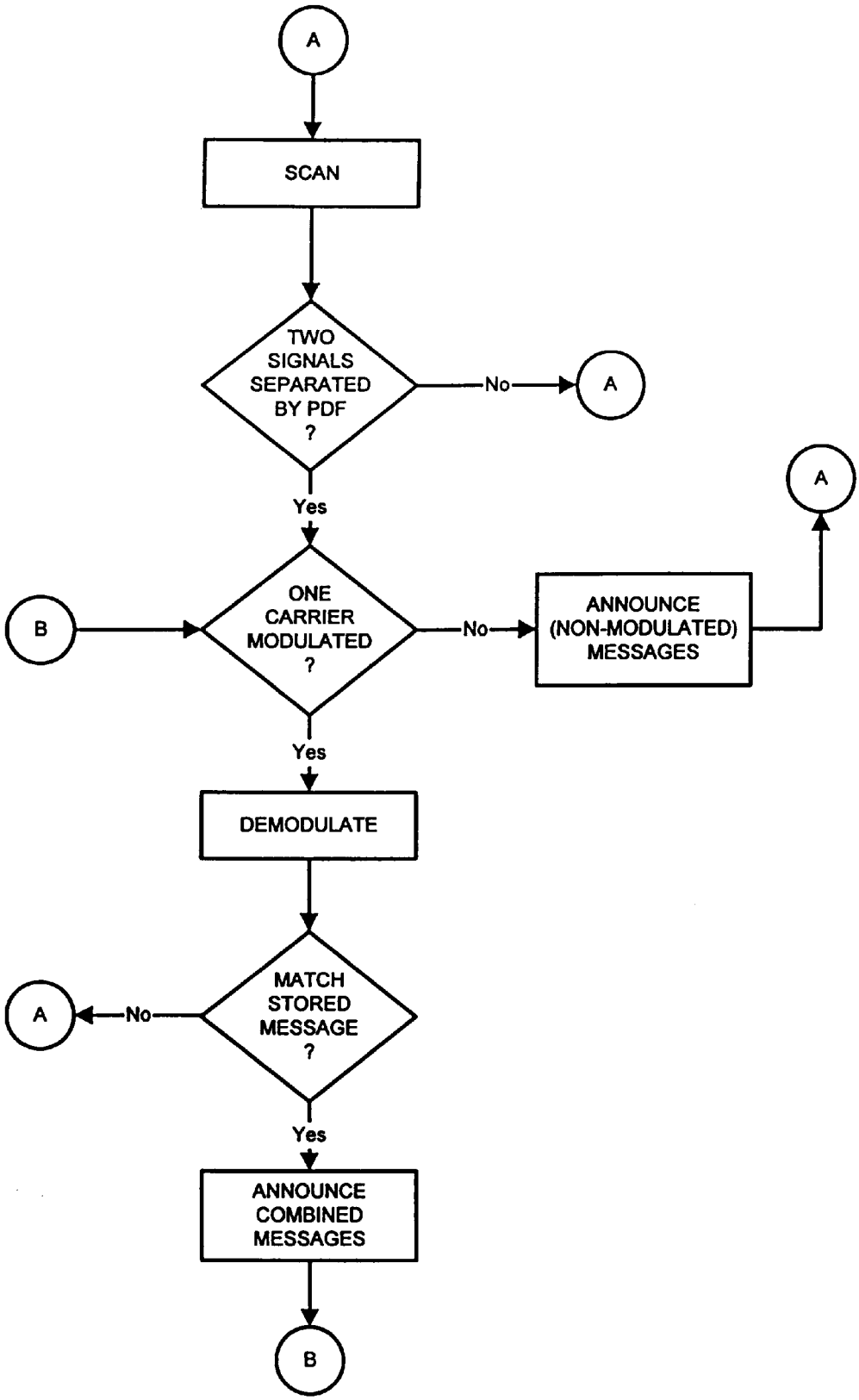
FIG. 3 is a flow chart of the logic of the receiver's microprocessor.

Detection of two carrier signals separated by one of a plurality of stored, predetermined PDF's indicates the presence of a respective one of a plurality of particular types of traffic situations. In the event the PDF is one of the acceptable plurality of PDF's, and neither of the carrier signals is modulated, the receiver will annunciate the message corresponding to the particular PDF. In the event the PDF is one of the acceptable plurality of PDF's, and one of the carrier signals is modulated, the receiver demodulates the modulated carrier signal. The receiver then compares the demodulated carrier signal to a plurality of stored, acceptable demodulated carrier signals to determine if the demodulated carrier signal matches one of the acceptable demodulated carrier signals. The modulated carrier signal, modulated with a modulating signal M, is used to indicate further information regarding the particular traffic situation. The receiver then annunciates the combined message. FIG. 3 illustrates this procedure as a flow chart.

As noted above, detection of two signals separated by a PDF of 120 MHz indicates the presence of an emergency vehicle. The modulating signal M adds to that information, such as that the emergency vehicle is a police car, or alternatively an ambulance, or the like.

Thus, the same modulated signal could have two meanings, depending on the PDF of the two detected carrier signals. This scheme has the further benefit that should the modulated signal be distorted, the primary signal (i.e., based on the PDF) would still be detected and annunciated.

It should also be understood that the modulating signal M either can be a digital signal or an analog signal, such as a tone, depending upon the selection of the designer. In the preferred embodiments described herein, the modulating signal is a digital signal.

Figure 4:
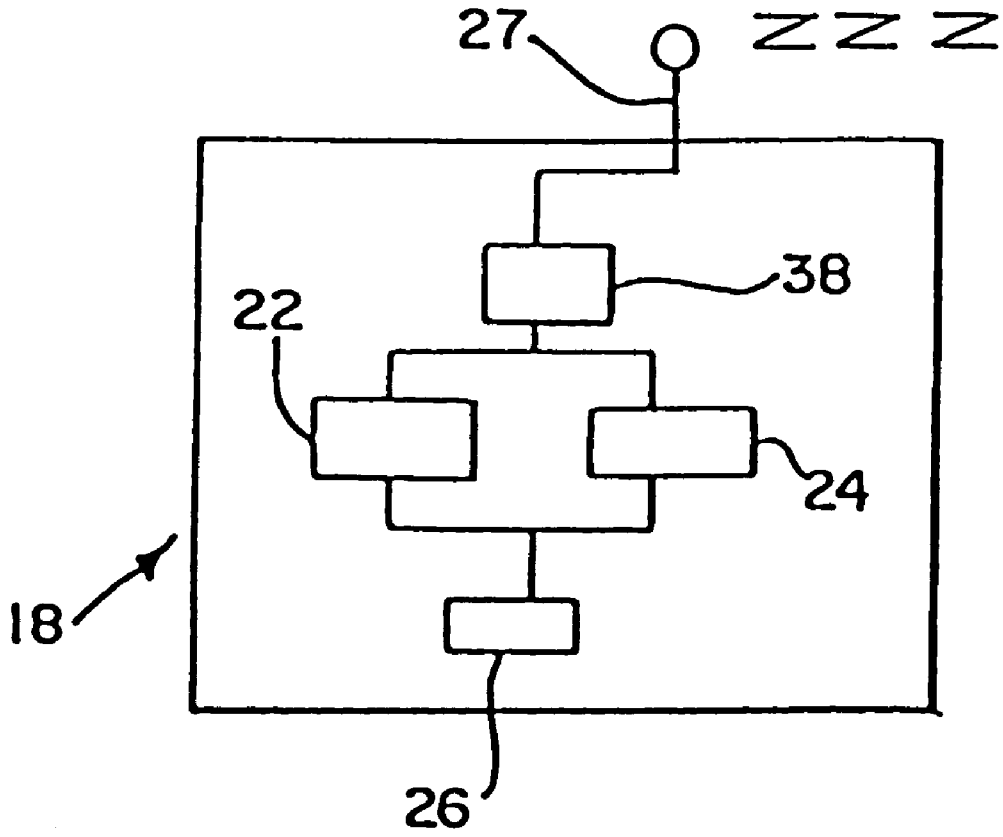
FIG. 4 is a block diagram of an alternative embodiment of the transmitter of FIG. 2.

Finally, in certain situations it may be desirable to provide a toggle system such that the first and second oscillators are toggled on and off so that when the first oscillator is transmitting the second oscillator is not and when the second oscillator is transmitting the first is not. FIG. 4 illustrates toggling circuitry 38 in block diagram form.

One situation in which a toggle system may be desirable is when like transmitters are in close proximity with one another. If the rate at which the toggle system turns each one of the oscillators on and off varies for each type of traffic situation, the likelihood of two like transmitters interfering with each other would be minimized, particularly if both oscillators are also pulsed so that neither one is on even 50% of the time.

The possibility does exist for the simultaneous occurrence of multiple roadside hazards, multiple emergency vehicles, or combinations of the two. In such a case, the microprocessor could be assigned a hierarchy so that, for example, detection of the presence of an emergency vehicle would take priority over detection of the presence of a roadside hazard. The result would be that the receiver 20 would announce a message indicating the presence of a traffic situation involving an emergency vehicle.

It will be understood that the invention may be embodied in other specific forms without departing from the spirit or central characteristics thereof. The present embodiments, therefore, are to be considered in all respects as illustrative and not restrictive, and the invention is not to be limited to the details given herein.

What is claimed is:

1. A traffic information warning system for conveying a message regarding a traffic situation from a traffic advisory site, the system comprising a transmitter adapted for placement at the advisory site and a receiver, wherein:

the transmitter includes an oscillator for transmitting a first carrier signal and a second carrier signal, the first carrier signal having a first carrier frequency and the second carrier signal having a second carrier frequency, a modulator for modulating the first carrier signal with a modulating signal reflective of a traffic situation, the second carrier signal comprising an unmodulated signal, the first carrier frequency and the second carrier frequency being spaced apart by a predetermined frequency difference; and the receiver includes scanning circuitry for scanning across a predetermined frequency range to detect carrier signals separated by the predetermined frequency difference, a demodulator for retrieving a first retrieved modulating signal about the first carrier signal, means for comparing the first retrieved modulating signal to a series of acceptable stored traffic messages and for determining whether the first retrieved modulating signal matches one of the acceptable stored traffic messages, and means for announcing a message regarding the traffic situation.

2. The traffic information warning system of claim 1 wherein the announcing means includes an audible sound.

3. The traffic information warning system of claim 2 wherein the audible sound is a voice-synthesized message.

4. The traffic information warning system of claim 1 wherein the announcing means includes a visible display.

5. The traffic information warning system of claim 1 wherein the announcing means does not announce a message regarding the traffic situation when the first retrieved modulating signal does not match one of the stored traffic messages and does announce a message regarding the traffic situation where the first retrieved modulating signal matches one of the stored traffic messages.

6. The traffic information warning system of claim 1 wherein the traffic advisory site comprises an emergency vehicle.

7. The traffic information warning system of claim 1 wherein the traffic advisory site comprises a roadside hazard.

8. The traffic information warning system of claim 1 wherein toggle means are provided to toggle the first oscillator and second oscillator on and off, so that when the first oscillator is on the second oscillator is off and when the second oscillator is on the first oscillator is off.

9. A traffic information warning system for conveying a message regarding a traffic situation from a traffic advisory site, the system comprising a transmitter adapted for placement at the advisory site, the system comprising a transmitter adapted for placement at the advisory site and a receiver, wherein:

the transmitter includes a first oscillator for transmitting a first carrier signal and a second oscillator for transmitting a second carrier signal, the first carrier signal having a first predetermined carrier frequency and the second carrier signal having a second predetermined carrier frequency, the first and second carrier frequency separated by a predetermined frequency difference, a modulator for modulating the first carrier signal with a modulating signal reflective of a traffic situation, the second carrier signal comprising an unmodulated signal; and, the receiver includes scanning circuitry for scanning across a predetermined frequency range to detect carrier signals separated by the predetermined frequency difference, and a demodulator for retrieving a first retrieved modulating signal about the first carrier signal at the first predetermined carrier frequency, means for comparing the first retrieved modulating signal to a series of acceptable stored traffic messages and for determining whether the first retrieved modulating signal matches one of the acceptable stored traffic messages, and means for announcing a message regarding the traffic situation.

10. The traffic information warning system of claim 9 wherein the announcing means includes an audible sound.

11. The traffic information warning system of claim 10 wherein the audible sound is a voice-synthesized message.

12. The traffic information warning system of claim 9 wherein the announcing means includes a visible display.

13. The traffic information warning system of claim 9 wherein the announcing means does not announce a message regarding the traffic situation when the first retrieved modulating signal does not match one of the stored traffic messages and does announce a message regarding the traffic situation when the first retrieved modulating signal matches one of the stored traffic messages.

14. The traffic information warning system of claim 9 wherein the traffic advisory site comprises an emergency vehicle.

15. The traffic information warning system of claim 9 wherein the traffic advisory site comprises a roadside hazard.

16. The traffic information warning system of claim 9 wherein toggle means are provided to toggle the first oscillator and second oscillator on and off, so that when the first oscillator is on the second oscillator is off and when the second oscillator is on the first oscillator is off.

17. A traffic information warning system for conveying first and second messages regarding a traffic situation from a traffic advisory site, the system comprising a transmitter adapted for placement at the advisory site and a receiver wherein:

the transmitter includes a first oscillator for transmitting a first carrier signal and a second carrier signal, the first carrier signal having a first discrete carrier frequency and the second carrier signal having a second discrete carrier frequency, the first and second discrete carrier signal frequencies being located at a frequency location and the first message of a traffic situation being reflective of the specific frequency locations of the first and second discrete frequencies, a modulator for modulating the first carrier signal with a modulating signal reflective of the second message regarding a traffic situation, the second carrier signal comprising an unmodulated signal; and, the receiver includes scanning circuitry for scanning across a predetermined frequency range to detect first and second carrier signals, means responsive to the detecting means for determining the first message regarding traffic situation, a demodulator for retrieving a first retrieved modulating signal about the first carrier signal, and means for announcing the first and second messages regarding the traffic situation.

18. The traffic information warning system of claim 17 wherein the announcing means includes an audible sound.

19. The traffic information warning system of claim 18 wherein the audible sound is a voice-synthesized message.

20. The traffic information warning system of claim 17 wherein the announcing means includes a visible display.

* * * * *